US009227769B2

(12) United States Patent
Skillin et al.

(10) Patent No.: US 9,227,769 B2
(45) Date of Patent: Jan. 5, 2016

(54) DELAYED FLOW BAFFLED DISPENSING CLOSURE

(75) Inventors: Clifford Skillin, Blackstone, MA (US); Patrick Brannon, Warwick, RI (US)

(73) Assignee: WESTROCK SLATERSVILLE, LLC, Norcross, GA (US)

( * ) Notice: Subject to any disclaimer, the term of this patent is extended or adjusted under 35 U.S.C. 154(b) by 0 days.

(21) Appl. No.: 14/131,708

(22) PCT Filed: Jul. 16, 2012

(86) PCT No.: PCT/US2012/046963

§ 371 (c)(1), (2), (4) Date: Feb. 13, 2014

(87) PCT Pub. No.: WO2013/012821

PCT Pub. Date: Jan. 24, 2013

(65) Prior Publication Data

US 2014/0144949 A1 May 29, 2014

Related U.S. Application Data

(60) Provisional application No. 61/535,380, filed on Sep. 16, 2011, provisional application No. 61/508,170, filed on Jul. 15, 2011.

(51) Int. Cl.

| | |
|---|---|
| ***B67D 3/00*** | (2006.01) |
| ***B67D 7/06*** | (2010.01) |
| ***B65D 47/04*** | (2006.01) |
| ***B65D 47/24*** | (2006.01) |

(52) U.S. Cl.

CPC ..... *B65D 47/043* (2013.01); *B65D 47/242* (2013.01)

(58) Field of Classification Search

CPC ..... B65D 47/043; B65D 47/242
USPC ..... 222/520, 521, 519, 525, 546, 547, 564; 215/386, 387
See application file for complete search history.

(56) References Cited

U.S. PATENT DOCUMENTS

| | | | | |
|---|---|---|---|---|
| 2,474,746 | A | 6/1949 | Lopez et al. | |
| 2,700,484 | A | 1/1955 | Rathsprecher | |
| 3,102,651 | A | 9/1963 | Boese | |
| 3,143,257 | A | 8/1964 | Mumford | |
| 4,065,037 | A * | 12/1977 | Haller | 222/153.02 |
| 4,117,551 | A | 9/1978 | Books et al. | |
| 4,370,062 | A | 1/1983 | Moody | |
| 4,880,140 | A | 11/1989 | Solomon et al. | |
| 4,907,725 | A | 3/1990 | Durham | |
| 5,048,723 | A * | 9/1991 | Seymour | 222/81 |

(Continued)

*Primary Examiner* — J. Casimer Jacyna
*Assistant Examiner* — Benjamin R Shaw
(74) *Attorney, Agent, or Firm* — Barlow, Josephs & Holmes, Ltd.

(57) ABSTRACT

A dispensing closure having a closure body and an insert member for dispensing a product from a container. The insert member includes a base and a sealing tube. The base is configured and arranged for seating within an open end of the product container. The sealing tube extends upwardly from the base. The sealing tube has a sealing tip portion at an upper end thereof. The sealing tube further includes one or more baffles spaced apart along the sealing tube. Each of the baffles positioned along a different horizontal axis to restrict direct flow of a product out of the dispensing closure. In operation, the closure body moves relative to the relative to the insert member between a closed position to prevent a baffled flow product to exit the exit orifice area and an open position to allow a baffled flow of product to exit the exit orifice area.

4 Claims, 8 Drawing Sheets

(56) References Cited

U.S. PATENT DOCUMENTS

| | | | | |
|---|---|---|---|---|
| 5,111,977 | A * | 5/1992 | Maguire et al. | 222/521 |
| 5,123,575 | A | 6/1992 | Li | |
| 5,280,764 | A | 1/1994 | Levinrad | |
| 5,310,097 | A | 5/1994 | Leuenberger | |
| 5,354,347 | A | 10/1994 | McCoy et al. | |
| 5,383,581 | A | 1/1995 | LeMarbe et al. | |
| 5,549,222 | A * | 8/1996 | Schroeder | 222/129.1 |
| 5,570,822 | A | 11/1996 | LeMarbe et al. | |
| 6,065,648 | A * | 5/2000 | Tauber | 222/153.14 |
| 6,168,415 | B1 * | 1/2001 | Pleasant et al. | 425/552 |
| 6,244,476 | B1 * | 6/2001 | Moretti | 222/521 |
| 6,644,620 | B2 | 11/2003 | Johnson et al. | |
| 6,669,063 | B1 * | 12/2003 | Schneider et al. | 222/521 |
| 6,808,091 | B2 * | 10/2004 | Njaastad | 222/459 |
| 7,032,843 | B1 | 4/2006 | Johnson et al. | |
| 7,213,727 | B2 | 5/2007 | Kokubo | |
| 7,637,402 | B2 | 12/2009 | Romanov et al. | |
| 7,641,065 | B2 * | 1/2010 | Wang Wu | 215/387 |
| 7,690,539 | B1 | 4/2010 | Tudor et al. | |
| 2002/0125273 | A1 * | 9/2002 | Sittler | 222/521 |
| 2005/0167455 | A1 | 8/2005 | Yim | |
| 2006/0196894 | A1 * | 9/2006 | Lindsay | 222/521 |
| 2008/0054026 | A1 * | 3/2008 | Romanov et al. | 222/547 |
| 2008/0054027 | A1 * | 3/2008 | Skillin et al. | 222/547 |
| 2010/0072231 | A1 | 3/2010 | Bloom et al. | |
| 2010/0282174 | A1 | 11/2010 | Pappas | |
| 2014/0252038 | A1 * | 9/2014 | De Rosa | 222/153.14 |

* cited by examiner

DELAYED FLOW BAFFLED DISPENSING CLOSURE

BACKGROUND

The present disclosure relates to container closures, and more particularly to squeeze-type container dispensing closures. The exemplary embodiment of the present application relates to the dispensing closure having a closure body and insert member with one or more baffles for restricting the direct flow or spurting of the product, especially when the product container is inverted but not yet squeezed.

SUMMARY

A first exemplary embodiment of a dispensing closure in accordance with the teachings herein is operable for dispensing a product from a container. The product, in one embodiment, may be a liquid product and the container may be a squeeze-type container. The two-piece dispensing closure for dispensing a product from a container includes closure body and an inset member. The insert member having one or more baffles for restricting the direct flow or spurting of the product, especially when the product container is inverted but not yet squeezed.

The insert member includes a base and a sealing tube. The base configured and arranged for seating within an open end of the product container. The sealing tube extends upwardly from the base. The sealing tube has a sealing tip portion at an upper end thereof. The sealing tube further includes one or more baffles spaced apart along the sealing tube. Each of the baffles positioned along a different horizontal axis to restrict direct flow of a product out of the dispensing closure. In one embodiment, the one or more baffles are baffles defining a half-moon shape.

The closure body includes an upper deck and a skirt depending from the upper deck. The skirt is configured and arranged to mount to a product container. In one embodiment, the closure body is rotatable relative to the base between the closed and open position. The closure body includes a stop mechanism configured to step rotation of the closure body in the open position. In another embodiment the closure body includes a CR (child-resistant) locking mechanism.

In one embodiment, there is a clearance area between an inner diameter of the flow conduit and an outer diameter of the baffles to allow some limited direct flow to mix with the baffled flow of product before exiting through the exit orifice area.

The flow conduit extends from the upper deck to provide a flow path from an interior of the closure to an exterior of the closure. The flow conduit includes an entrance orifice area and an exit orifice area. The flow conduit has an inner wall extending between the entrance orifice area and the exit orifice area. In one embodiment, the flow conduit includes a tip portion having a sharp inside-edge that provides a clean cut-off when righting the product container after dispensing the product.

In operation, the closure body moves relative to the relative to the insert member between a closed position, wherein a sealing tip portion of the sealing tube engages the inner wall of the flow conduit near the exit orifice area and prevents a flow of product from exiting said exit orifice area, and an open position, wherein the inner wall of the flow conduit near the exit orifice area is spaced from the sealing tip portion of the sealing tube to allow a baffled flow of product to exit the exit orifice. The insert member and closure body configured and arranged to allow product to exit the exit orifice area when the closure body is in the open position and the container is inverted and squeezed.

Objectives, features and advantages of the embodiments shall become apparent as the description thereof proceeds when considered in connection with the accompanying illustrative drawings.

BRIEF DESCRIPTION OF THE DRAWING FIGURES

In the drawings which illustrate several exemplary modes for carrying out the present invention:

Figure 5:
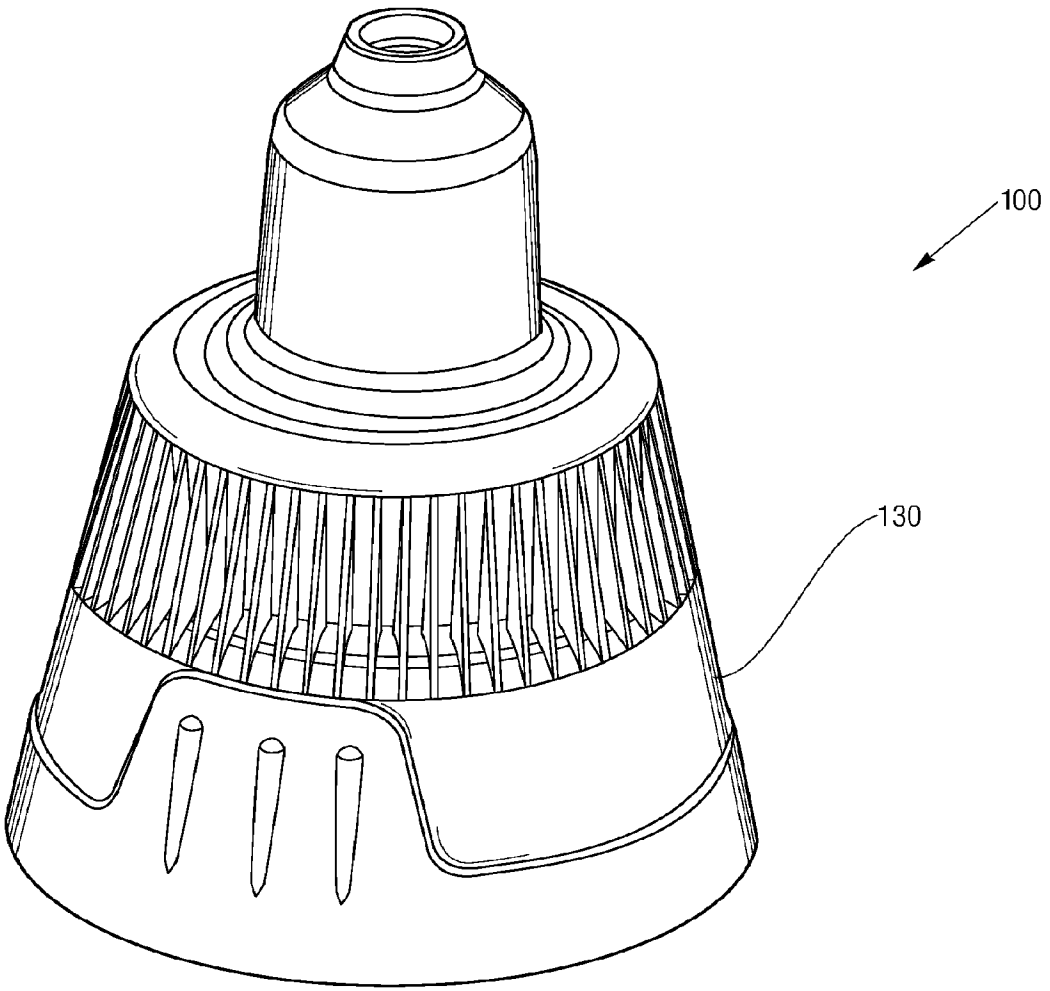
FIG. 5 is perspective view of a second exemplary embodiment of the dispensing closure including a closure body and insert member.
Figure 6:
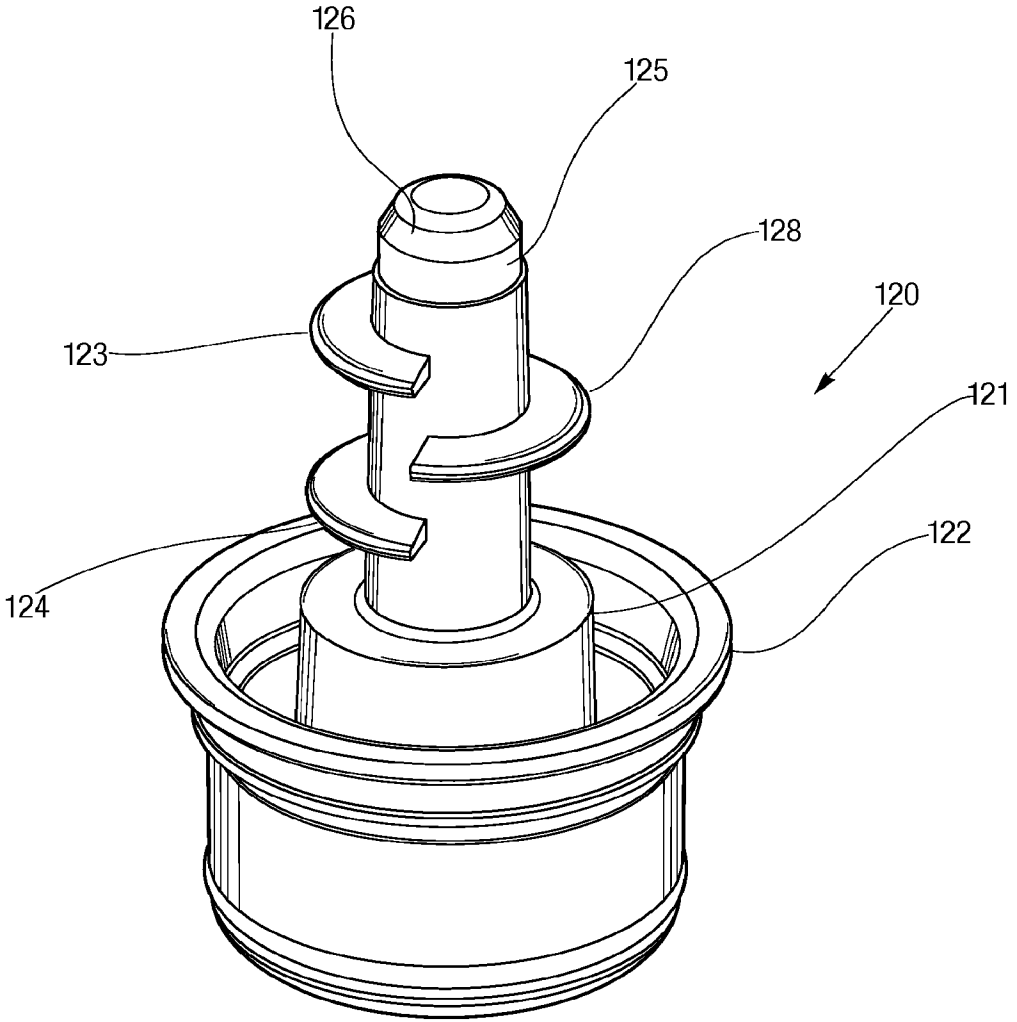
FIG. 6 is a perspective view of the insert member of FIG. 5 which includes three half-moon baffles that are on separate horizontal planes.
Figure 7:
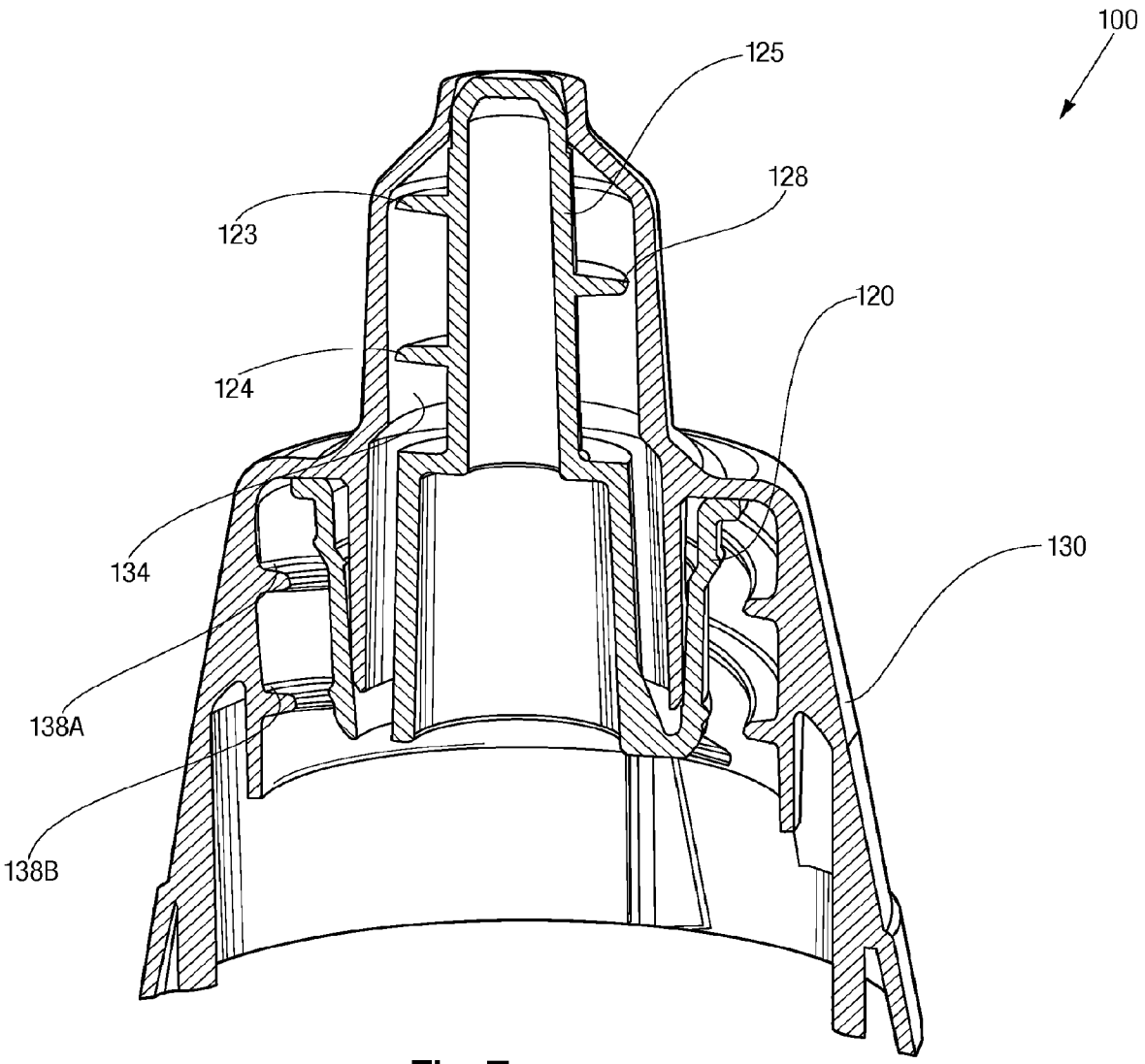
Figure 8:
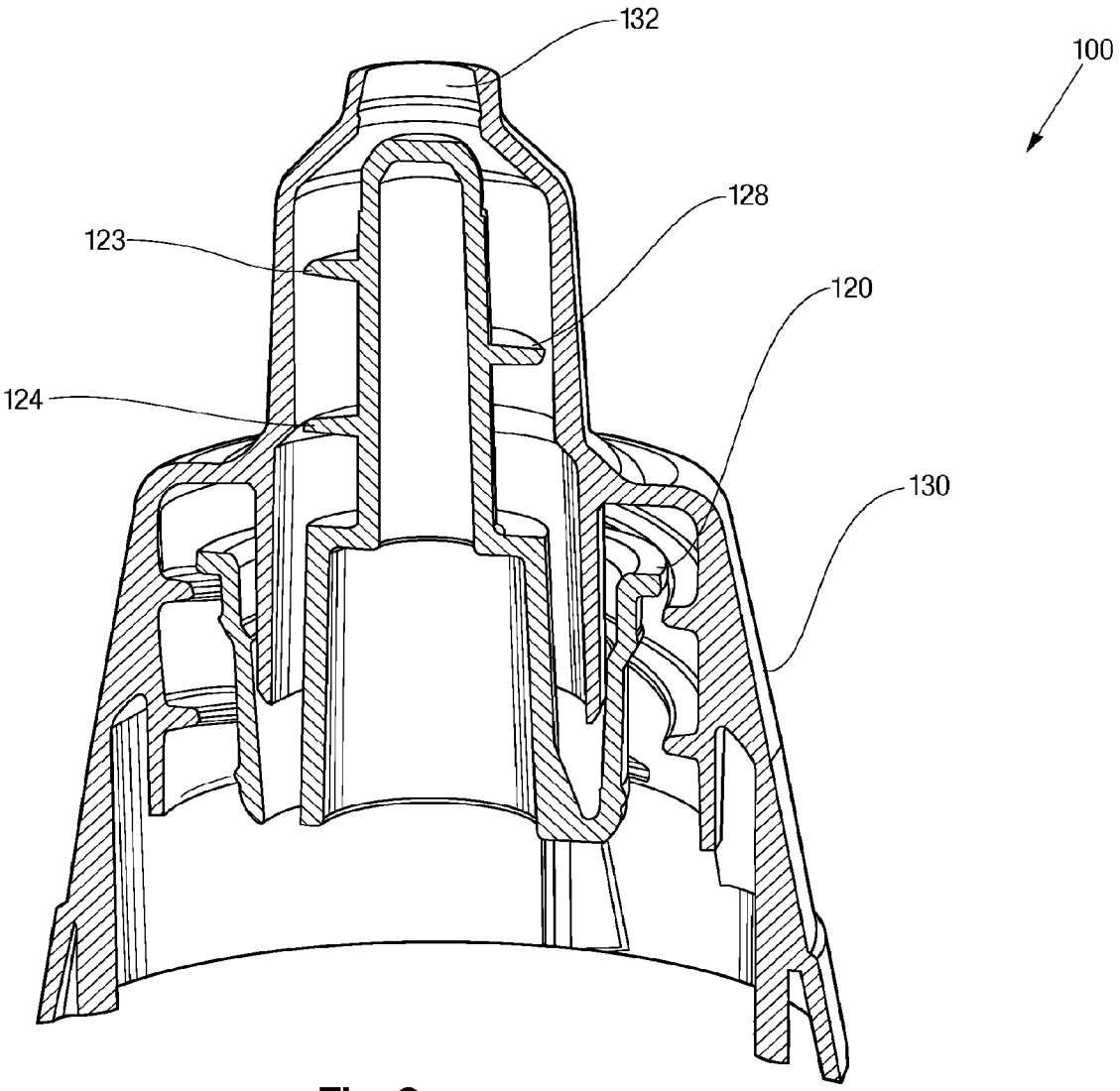

FIG. 7 is a cross-sectional view of FIG. 5 showing the insert member engaging the exit orifice area of the dispensing closure which is in a closed position to prevent the flow of liquid through the exit orifice area of the dispensing closure; and FIG. 8 is a cross-sectional view of FIG. 5 showing the insert member disengaged from the dispensing closure which is in an open position to allow the flow of liquid through the exit orifice area of the dispensing closure.

DETAILED DESCRIPTION OF A PREFERRED EMBODIMENT

Referring now to the drawings, a first exemplary embodiment is illustrated and generally indicated at 10 in FIGS. 1-4. As will hereafter be more fully described, the first exemplary embodiment of a dispensing closure 10 in accordance with the teachings herein is operable for dispensing a product from a product container (not shown), preferably a squeeze-type container. For purposes of the present disclosure, the product, in one embodiment, may be a liquid product.

The exemplary embodiment of the present application relates to the dispensing closure 10 having a closure body 30 and insert member 20 with one or more baffles 23, 24 for restricting the direct flow or spurting of the product, especially when the product container is inverted but not yet squeezed.

Referring to FIGS. 1-4, the dispensing closure 10 is a two-piece dispensing closure for dispensing a product from the container. The dispensing closure 10 is configured to regulate or restrict the flow product, such as a liquid or other substance, through an exit orifice area 32 of the dispensing closure 10. In one embodiment, the two-piece dispensing closure is a two-piece delayed flow baffle dispensing closure.

The dispensing closure 10 includes the closure body 30 and the insert member 20. In one embodiment, the dispensing closure 10 is made of plastic material but may be made of any other suitable materials for dispensing a product. The closure body 30 may be also referred to as a dispenser cap.

The insert member 20 includes an insert base 22 and a sealing tube portion 25. The base 22 is configured and arranged for seating within an open end of the product container. The sealing tube portion 25 extends upwardly from the base 22 to occupy an interior volume of a flow conduit 34. The sealing tube 25 has a sealing tip portion 26 at an upper end thereof. In one embodiment, the sealing tip portion 26 has a diameter substantially similar to an inner diameter of the exit orifice area 32 of the flow conduit 34.

The sealing tube 25 further includes one or more baffles 23, 24 spaced apart and positioned along an exterior surface of the sealing tube 25. The baffles 23, 24 have a diameter less than an inner diameter of the flow conduit 34. The purpose of the baffles 23, 24 is to force the product to flow between the baffles 23, 24 thereby restricting the direct flow of the product through the exit orifice area 32 of the dispensing closure 10. In one embodiment, the baffles 23, 24 share a common vertical axis A. In another embodiment, each baffle 23, 24 has 180 degree angle along a horizontal axis. Each of the baffles 23, 24 are positioned along a different or separate horizontal axis B, C to restrict direct flow of a product out of the dispensing closure 10. In one embodiment, the one or more baffles are baffles 23, 24 defining a half-moon shape. Of course, the baffles 23, 24 may define other shapes which are as effective as the half-moon shape in restricting the direct flow of product out of the dispensing closure 10.

The insert member 20 with two baffles 23, 24 along the sealing tube 25 restricts and prevents the spurting of direct flow of product from the dispensing closure 10. In this embodiment, the sealing tube 25 is positioned within the flow conduit 34 using one or more elevated portions 27A-D of the insert base 22. The elevated portions 27A-D may correspond to the number of baffles 23, 24 in a two to one ratio. For example, there may be four elevated portions 27A-D for every two baffles 23, 24. In addition, both the elevated portions 27A-D and the sealing tube 25 have a non-solid surface area or cut-out areas. In one embodiment, the sealing tube 25 defines a length substantially similar to the length of the flow conduit 34 above an upper deck 36 of the closure body 30.

The closure body 30 includes the upper deck 36 and a skirt 38 depending from the upper deck 36. The skirt 38 is configured and arranged to mount to a product container (not shown), such as a squeeze-type product container or inverted-type container. The skirt 38 includes threads 38A, 38B for threaded mounting on an open end or neck of the product container.

Figure 1:
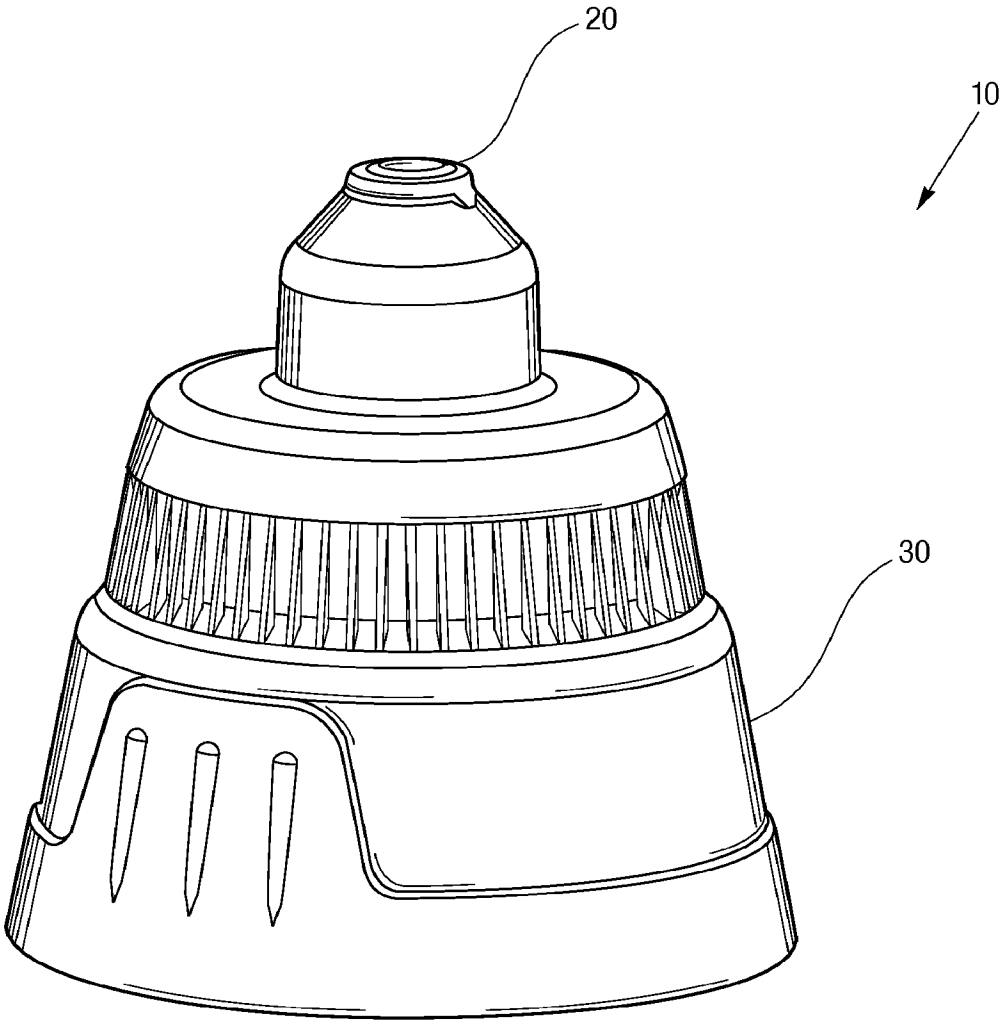
FIG. 1 is a perspective view of a first exemplary embodiment of the dispensing closure including the closure body and insert member.
Figure 2:
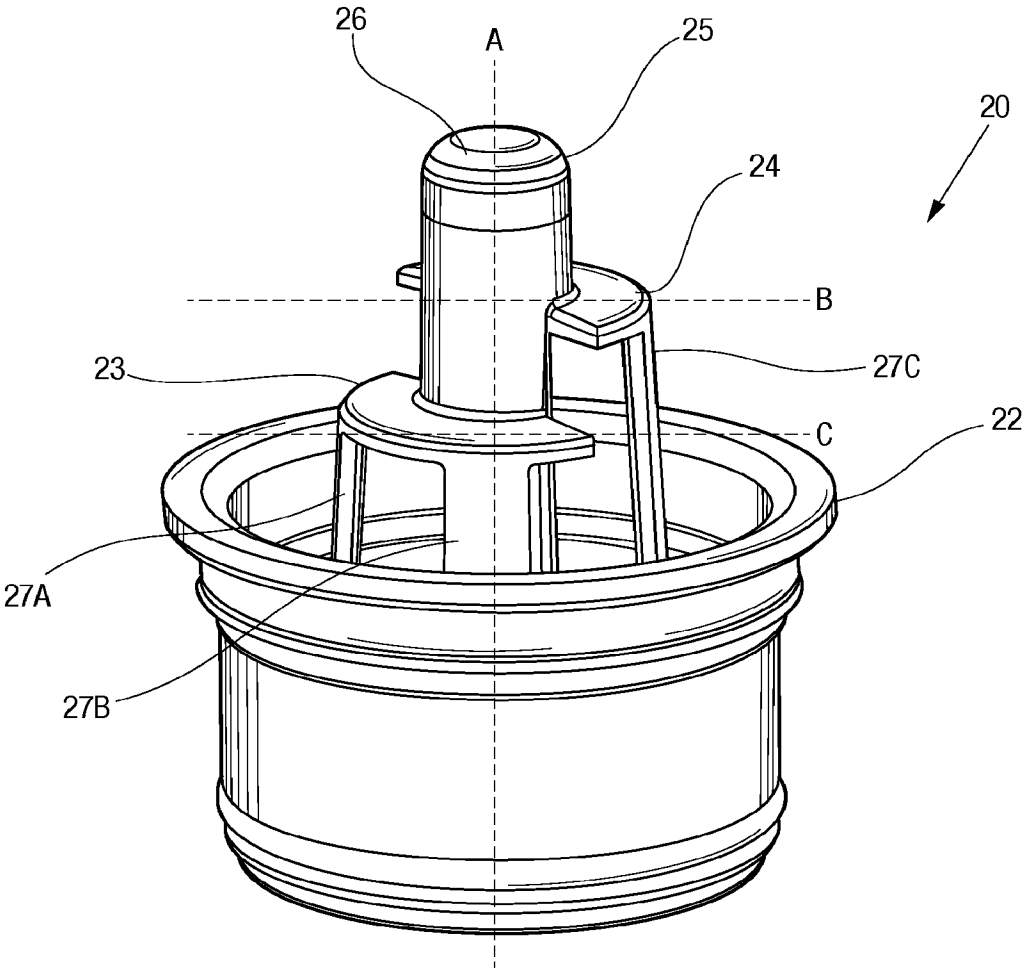
FIG. 2 is a perspective view of the insert member of FIG. 1 which includes two half-moon baffles that are on separate horizontal planes.
Figure 3:
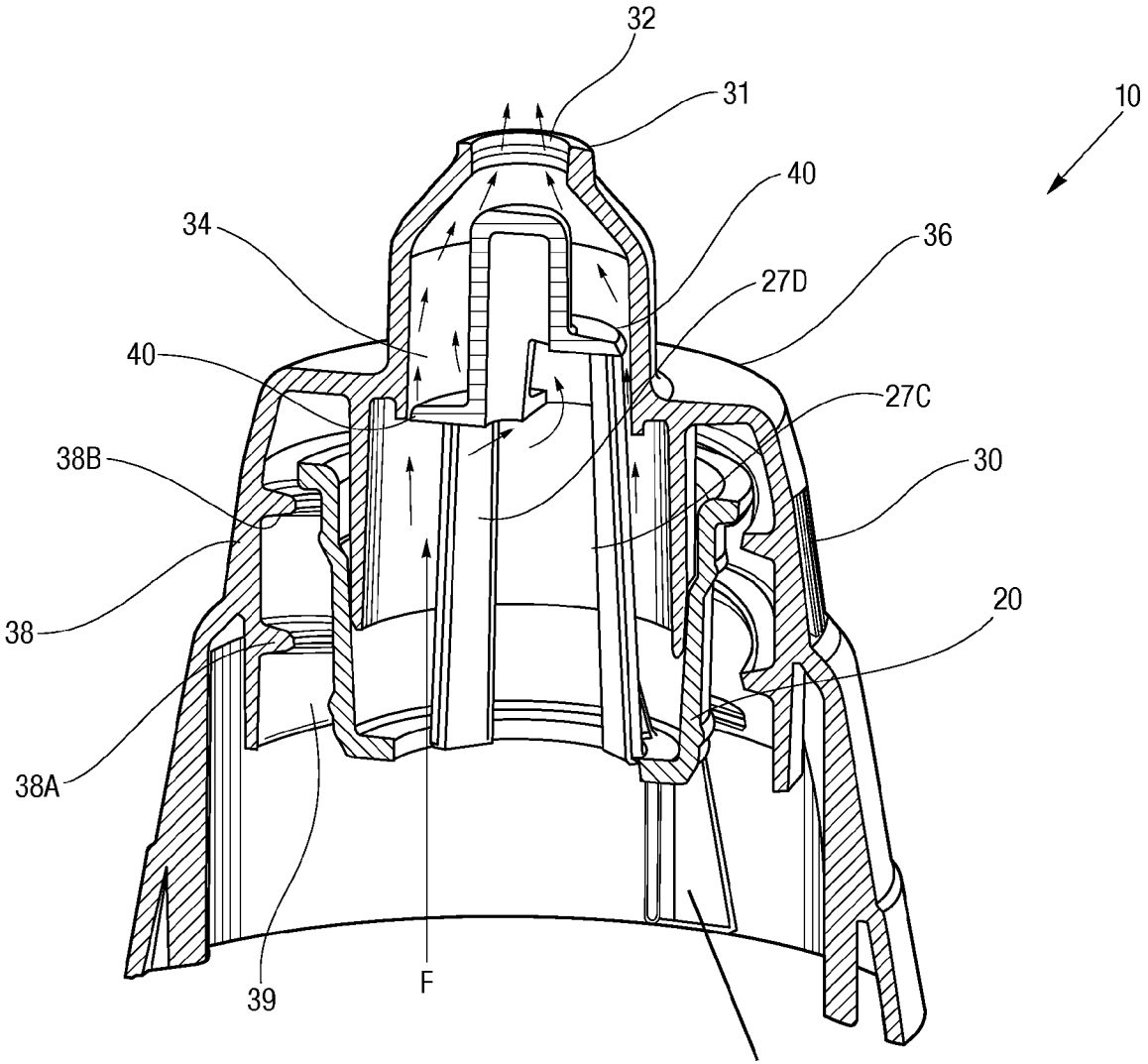
FIG. 3 is a cross-sectional view of FIG. 1 showing the insert member disengaged from the dispensing closure which is in an open position to allow the flow of liquid through the exit orifice area of the dispensing closure.

In one embodiment, the closure body 30 is rotatable relative to the insert member 20 between the closed (FIG. 4) and the open position (FIG. 3). Still referring to FIG. 3, closure body 30 includes a stop mechanism, i.e., opposed stopping tabs 33 (only one shown) to stop rotation of the closure body in the open position. In another embodiment the closure body includes a CR (child-resistant) locking mechanism. For example, the closure body further includes two pairs of opposing stopping tabs which cooperate with a single pair of opposed stopping lugs on a neck of a container to provide a child-resistant (CR) mechanism.

The closure body 30 includes the flow conduit 34. The flow conduit 34 extends from the upper deck 36 to provide a flow path from an interior of the closure 10 to an exterior of the dispensing closure 10. The flow conduit 34 includes an entrance orifice area 39 and the exit orifice area 32 having an exit orifice. The flow conduit 34 has an entrance orifice area 39 within an interior of the closure body 30 and an exit orifice area 32 outside the exterior of the closure body 30. In one embodiment, the flow conduit 34 is raised in an elongated manner outside the exterior surface of the closure body 30. The flow conduit 34 has an inner wall extending between the entrance orifice area and the exit orifice area.

In one embodiment, the flow conduit 34 also includes a tip portion 31 for facilitating the clean-cut off of the liquid or product upon exit from the exit orifice area 32. The tip portion 31 of the exit orifice area 32 has a sharp inside edge that creates a clean cut-off when righting the product container.

In addition, there is also a small clearance area 40 between the inner diameter of the closure body 30 above a threaded portion area 38A, 38B and an outer diameter of the insert member 20 which allows some limited direct flow to mix with the baffled flow of product before exiting through the exit orifice area 32. Referring to FIG. 3, arrows F represent the flow of some limited product directly through the small clearance area 40 and also product restricted by the baffles 23, 24. In another embodiment, there is a clearance area 40 between an inner diameter of the flow conduit 34 and an outer diameter of the baffles 23, 24 to allow some limited direct flow to mix with the baffled flow of product before exiting through the exit orifice area 32.

Once the product flows through the baffles 23, 24 of the insert member 22, the product is funneled through an exit orifice area 32 having a smaller diameter which also enhances and facilitates the flow of the product. Based upon information and belief, the addition of the baffles 23, 24 to the insert member substantially restricts the dispensing of a low viscosity product when the bottle is inverted and before squeezing. In one test, for example, the low viscosity product with the baffles 23, 24 spurted through the exit orifice area 32 to less than about 6 inches away or less whereas the insert member 22 without the baffles 23, 24 spurted through the exit orifice area 32 about six feet away or more. This delay and minimizing of spurting of the product until the container is inverted and then actually squeezed will result in avoiding needless wasting of product, conservation, and preventing unwanted spills.

Figure 4:
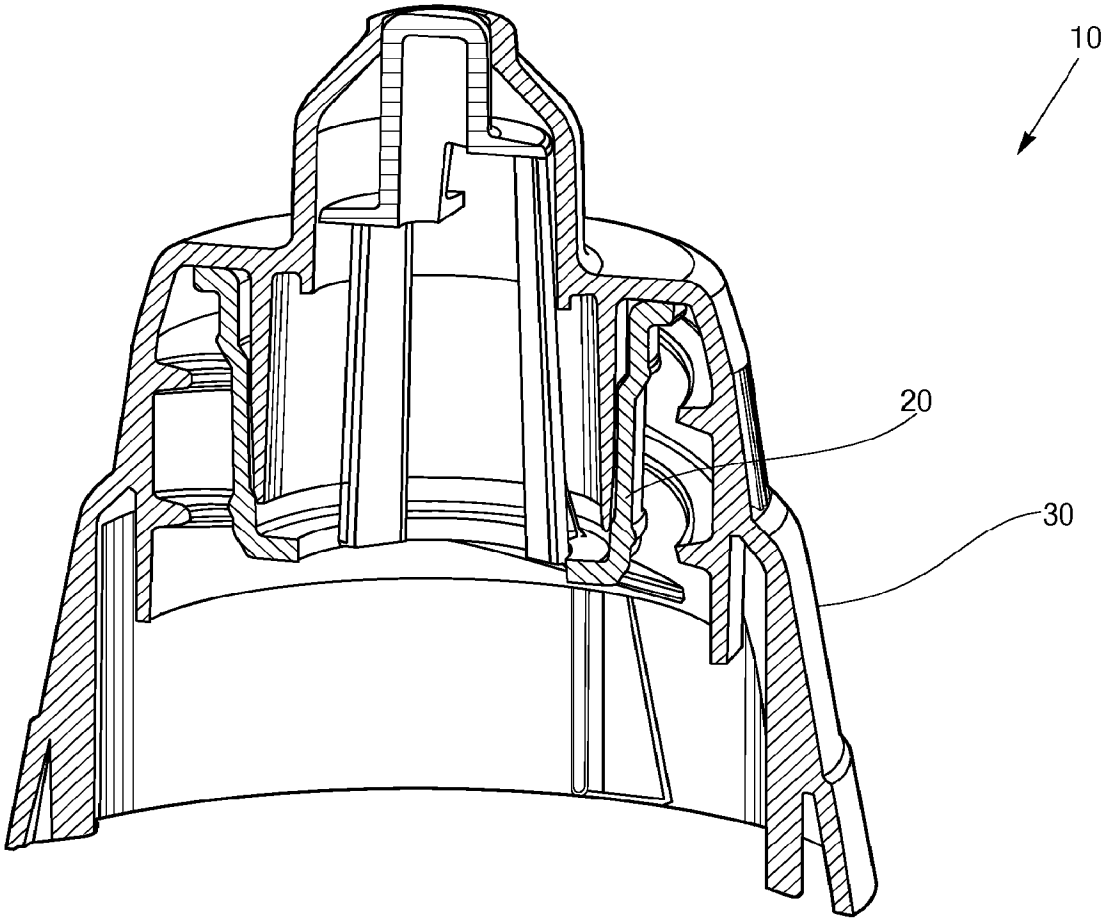
FIG. 4 is a cross-sectional view of FIG. 1 showing the insert member engaging the exit orifice area of the dispensing closure which is in a closed position to prevent the flow of liquid through the exit orifice area of the dispensing closure.

In operation, referring to FIGS. 3 and 4, the closure body 30 moves relative to the insert member 20 between a closed position (FIG. 4) and an open position (FIG. 3). The closed position of the dispensing closure 10 occurs when the sealing tip portion 26 of the sealing tube 25 engages the inner walls of the flow conduit 34 near the exit orifice area 32 and prevents a flow of product from exiting the exit orifice area 32.

The open position of the dispensing closure 10 occurs when the inner walls of the flow conduit 34 near the exit orifice area 32 are spaced from the sealing tip portion 26 of the sealing tube 25 to allow some limited direct flow to mix with the baffled flow of product before exiting through the exit orifice area.

In another embodiment, the open position may also require the closure body 30 to be squeezed and then rotated to disengage from the CR (child-resistant) stopping lugs and rotated about 90 degrees or more to the stop lug for an open position of the closure body relative to the insert member. In the open position, the user inverts the bottle to dispense the product through the exit orifice.

During the dispensing of the product, the one or more half-moon baffles 23, 24 on the insert member 20 restricts the product flow between the baffles 23, 24 and restricts the direct flow of the product out of the exit orifice area 32. After the dispensing, the user gradually returns the product container to an upright position whereby the tip portion 31 on the exit orifice area 32 having a sharp inside edge creates a clean cut-off of the product. Thereafter, referring to FIG. 4, the closure body 30 rotates into sealing connection with the sealing tube portion 25 of the insert member 20 to the closed position to prevent the product from exiting through the exit orifice area 32.

Referring to FIGS. 5-8, a second exemplary embodiment of the dispensing closure 100 incorporates the advantages and benefits of the above-mentioned dispensing closure 10 having a closure body 130 and insert member 120 with one or more baffles 123, 124, 128 for restricting the direct flow or spurting of the product out of the dispensing closure, especially when the product container is inverted but not yet squeezed. The two-piece dispensing closure 100 of the second exemplary embodiment further includes three or more baffles 123, 124, 128 positioned along the insert member 120 and a different configuration of the insert member 120 and the closure body 130, which shall be explained further below.

Referring to FIGS. 5-8, the insert member has an insert base 122 and a sealing tube 125. The sealing tube 125 includes three baffles 123, 124, 128 positioned along the sealing tube 125 to further restrict and prevent the spurting of direct flow of product from the dispensing closure 100. Based upon information and belief, the use of three half-moon baffles 123, 124, 128 on the insert member 120 may provide further restriction of the direct flow of the product. In this embodiment, the sealing tube is positioned on a pedestal portion 121 of the insert base 122. In addition, both the pedestal portion 121 and the sealing tube 125 have a solid surface area.

Referring to FIGS. 7-8, the sealing tube 125 defines a length substantially similar to the length of the flow conduit 134 above the threaded area 138A, 138B of the closure body 30. In addition, the sealing tip portion 126 is slightly tapered to facilitate the sealing the inner walls of the exit orifice area 132 when the dispensing closure 100 is in a closed position.

In operation, the second exemplary embodiment 100 generally operates similar to the first exemplary embodiment 10 with regards to moving from an open (FIG. 8) to closed position (FIG. 7) to restrict the flow of product out of the exit orifice of the exit orifice area. The closed position of the dispensing closure 100 occurs when the sealing tip portion 126 of the sealing tube 125 engages the inner walls of the flow conduit 134 near the exit orifice area 132 and prevents a flow of product from exiting the exit orifice area 132.

The open position of the dispensing closure 100 occurs when the inner walls of the flow conduit 134 near the exit orifice area 132 are spaced from the sealing tip portion 126 of the sealing tube 125 to allow some limited direct flow to mix with the baffled flow of product before exiting through the exit orifice area.

While there is shown and described herein certain specific structure of the exemplary embodiments, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A dispensing closure for a product container having an outwardly threaded neck, comprising:

an insert member including a base configured and arranged to be received in interfitting seated engagement within the threaded neck of the container, a sealing tube extending upwardly from the base, said sealing tube having a sealing tip portion at an upper end thereof; and a closure body including, an upper deck, a skirt depending downwardly from the upper deck and having a threaded internal surface at an upper portion thereof which is configured and arranged to threadedly engage with the threaded neck of said container, said closure body being rotatably movable relative to said neck, a flow conduit extending from the upper deck to provide a flow path from an interior of the closure to an exterior of the closure, said flow conduit having a dispensing tip portion, said flow conduit including an entrance orifice and an exit orifice, said exit orifice at said dispensing tip portion, said flow conduit has an inner wall extending between the entrance orifice and the exit orifice, said closure body being rotatably movable relative to said base between a closed position wherein said sealing tip portion of said sealing tube matingly engages said inner wall of said flow conduit in the area of said dispensing tip and prevents a flow of liquid from exiting said exit orifice, and an open position wherein said inner wall of said flow conduit in the area of said dispensing tip portion is spaced from said sealing tip portion of said sealing tube and allows a flow of fluid to exit said exit orifice, said sealing tube further including a plurality of semi-circular baffles radiating outward from said sealing tube whereby a terminal outer edge thereof engages with said inner wall of said flow conduit to restrict flow through said flow conduit, each of said plurality of baffles being spaced apart along a longitudinal extent of the sealing tube and radiating outwardly in offset circumferential positions on different horizontal planes to prevent any direct flow of a product through the flow conduit from the entrance orifice to the exit orifice.

2. The dispensing closure of claim 1, wherein said closure body includes a stop mechanism configured to stop rotation of said closure body in said open position.

3. The dispensing closure of claim 1, wherein each of said plurality of baffles defines a semi-circular half-moon shape.

4. The dispensing closure of claim 2, wherein each of said plurality of baffles defines a semi-circular half-moon shape.

* * * * *